United States Patent [19]

Mino et al.

[11] 4,339,492

[45] Jul. 13, 1982

[54] HEAT-SENSITIVE RECORDING MATERIAL

[75] Inventors: Hisashi Mino; Masao Matsukawa; Minematsu Nagashima, all of Higashimatsuyama, Japan

[73] Assignee: Sanyo-Kokusaku Pulp Co., Ltd., Tokyo, Japan

[21] Appl. No.: 156,782

[22] Filed: Jun. 5, 1980

[30] Foreign Application Priority Data

Jun. 15, 1979 [JP] Japan ..... 54-74567

[51] Int. Cl.[3] ..... B41M 5/18

[52] U.S. Cl. ..... 428/320.4; 282/27.5; 427/150; 427/151; 428/320.8; 428/537; 428/913; 428/914

[58] Field of Search ..... 282/27.5; 427/150, 151; 428/307, 323, 327, 411, 537, 913, 914, 320.2, 320.4, 328.8, 488; 106/21

[56] References Cited

U.S. PATENT DOCUMENTS 3,539,375 11/1970 Baum et al. ..... 117/36.2

*Primary Examiner*—Bruce H. Hess

*Attorney, Agent, or Firm*—Oblon, Fisher, Spivak, McClelland & Maier

[57] ABSTRACT

A heat-sensitive recording material having a heat-sensitive layer composed mainly of a leuco dye, a phenolic compound and a water-soluble binding agent is characterized in that a combination of bisphenol A and p-phenylphenol is applied as the developer in a ratio by weight between 10:1 and 1:1, preferably 7:1 and 1:1.

1 Claim, No Drawings

HEAT-SENSITIVE RECORDING MATERIAL

BACKGROUND OF THE INVENTION

The present invention relates to a heat-sensitive recording material which makes a record of various types of information by thermal means, and more particularly to improvements in the chromogenic function of said recording material.

In certain types of information equipment, such as facsimilies, printers, recorders or the like, a system in which a record is made of information by thermal means has been developed in recent years. Keeping in step with the advent of such a system, it has been proposed to make use of a variety of heat-sensitive recording materials. Among others, currently noteworthy is a heat-sensitive recording material comprising a carrier or substrate having thereon a heat-sensitive layer composed mainly of a leuco dye that is colorless in its normal state, a developer such as a phenolic compound and a water-soluble binding agent.

The article "Berischte der deutschen chemischen Gesellschaft" by O. Fisher, F. Romer et al, 42.2934 (1909) describes a reaction between a chromogenic leuco dye, eg., crystal violet lactone and a phenolic compound resulting in color development. Color development caused by thermal means is also known from, for example, U.S. Pat. No. 3,539,375 and Japanese Patent Publication No. 14039/1970 specifications.

Usually, the heat-sensitive recording material of the type as mentioned just above is prepared by dispersing individually the leuco dye and the developer serving as a color-forming component in separate aqueous media containing a water-soluble resin acting as a binding agent, mixing together the resulting dispersions, and applying the mixture on a carrier followed by drying. A variety of dispersing means, such as ball mills, attritors, sand grinders or the like for fine pulverization, may be used. In principle, the recording material is then subjected to color development by softening or fusing the leuco dye, phenolic compound and water-soluble binding agent with the application of heat to bring both color-forming components in contact for a chromogenic reaction. In the actual embodiment, the dispersed particles preferably have a particle size as small as possible, e.g., on the order of several microns. Otherwise the heat-sensitive layer may become coarse-grained or rugged, thus decreasing the chromogenicity and the resolving power in addition to causing a lowering of quality. It is also important to provide isolated dispersions of particles without producing any foam during dispersion. Insufficient isolation and dispersion of particles present similar problems in respect of the chromogenic function and the resolving power, and may be responsible for the phenomenon referred to generally as primary color development. As will be understood from the foregoing, the quality of the heat-sensitive recording material is dependent largely upon the dispersibility of the color-forming components used.

Since the processing speed of various types of information equipment has increased, on the other hand, there is now a strong demand for heat-sensitive recording materials having a higher level of sensitivity. To this end, various attempts have been made to improve the sensitivity to heat of the recording material by the addition of diverse substances into the heat-sensitive layer in order to supplement the leuco dye, phenolic compound and binding agent. These substances include, for example, urea, phthalic anhydride, acetanilide (Japanese Patent Publication No. 4160/1698), waxes (Japanese Laid-Open Publication No. 19231/1973), nitrogen-containing compounds (Japanese Laid-Open Publication No. 34842/1974), acetoacetic anilide compounds (Japanese Laid-Open Publication No. 106746/1977), coumarone compounds (Japanese Laid-Open Publication No. 26139/1978) and the like. Although the mechanism of the sensitizing effect exerted by these substances has not yet been revealed, it can be assumed that they are first thermally fused at low temperatures causing the leuco dye or the phenolic compound to be molten and enhancing thereby the reaction between the color-forming components coming in contact with each other. Alternatively the mixture of the leuco dye and phenolic compound with the additional substances may have a eutectic point lower than the melting point of any one of the components, causing the color-forming components to be brought into contact at a faster rate and leading to increased heat-sensitivity. In any event, these substances are essentially differentiated from the color-forming ingredients, and are thermally fusible materials that take no direct part in the chromogenic reaction, and have a relatively low melting point.

In the use of these substances, however, difficulties are still encountered. In other words, some of the known substances produce a poor sensitizing effect while other produce a good sensitizing effect, but show an undersirable shelf life over an extended period of time thanks to the facile occurrence of liquid coloration or primary color development (this is especially true of water-soluble substances such as urea). In addition, certain types of these substances are so poor in dispersibility that they are not readily dispersed to fine particles or easily foamed. The conventional substances also pose an economic problem. Thus, no satisfactory substances are known.

SUMMARY OF THE INVENTION

It is therefore a main object of the present invention to provide a solution to the above-mentioned problems. More particularly, it is an object of the present invention to provide a heat-sensitive recording material which is easy to handle during the processing steps including dispersion, and has a level of sensitivity higher than that of any known developer without sacrificing other properties.

According to the present invention, the object is achieved by a heat-sensitive recording material having a heat-sensitive layer composed mainly of a leuco dye, a phenolic compound and a water-soluble binding agent, characterized in that a combination of bisphenol A and p-phenylphenol is applied as the developer in a ratio by weight between 10:1 and 1:1.

The above-mentioned objects and other objects and advantages of the present invention will become apparent to those skilled in the art upon reference to the following detailed description.

DETAILED DESCRIPTION OF THE INVENTION

It has so far been proposed to use numerous substances including a variety of phenolic compounds as the developer in heat-sensitive recording material. Thus, bisphenol A and p-phenylphenol, used in combination in the present invention, are known to those skilled in the art to be used separately. Surprisingly, however, it has now been found that a combination of bisphenol A and p-phenylphenol in the specified ratio by weight provides a novel heat-sensitive recording material having excellent features that are never attained by the use of either of the above-mentioned components alone or of any other conventional developer.

As a consequence of extensive investigations and studies carried out on a variety of developers including phenolic compounds, it has previously been noted that the most preferable developer is bisphenol A in view of all aspects including dispersibility, chromogenicity and shelf life. At the same time, it has been noted that p-phenylphenol has a fatal defect in that it is extremely poor in chromogenicity, although the p-phenylphenol poses no problem in respect of dispersibility and other quantities. Thus it is surprising to find that, when bisphenol A is used with p-phenylphenol, which is very poor in chromogenicity, in the specified ratio by weight, a heat-sensitive recording material is obtained having a higher level of heat-sensitivity which cannot be attained by the use of bisphenol A alone. In other words, the greatest characteristic feature of the present invention is that a higher level of heat-sensitivity is realized by the addition of a developer which has poor heat-sensitivity when used by itself. No explicit explanation can be given to the mechanism of such a sensitizing effect; however, it may be theorized that the effect is due to the fact that the eutectic point of a mixture of bisphenol A with p-phenylphenol is lower than the melting points of the respective components. While such a phenomenon is also observed in the conventional system utilizing various known sensitizers, there is a great difference between the conventional system and the present system, as will be understood from the description given below:

P-phenylphenol, although poor in chromogenicity may be said to be a developer, i.e., a component capable of taking direct part in the chromogenic reaction, unlike said conventional sensitizers. The reactivity of bisphenol A relative to the leuco dye increases with a lowering of the eutectic point. In addition, the reactivity of p-phenylphenol per se relative to the leuco dye increases, too. Thus, it can in retrospect be understood why such unexpected results are obtained as contemplated in the present invention. This can readily be demonstrated by the fact that bisphenol A has a melting point of 156° C. while p-phenylphenol has a higher melting point on the order of 167° C. Consistently, the addition of even a small amount of p-phenylphenol has a sensitizing effect (leading to improvements in sensitivity to heat) as compared with the system in which bisphenol A is the only developer and conventional sensitizers have been added.

In the present invention, bisphenol A is preferably added to the leuco dye in a ratio by weight between 1:2 and 1:5, and is applied to p-phenylphenol in a ratio by weight between 10:1 and 1:1, preferably 7:1 and 1:1. P-phenylphenol applied in an amount smaller than the lower limit has an unpreferable sensitizing effect, while it displays an undesirable shelf life in an amount exceeding the upper limit.

In what follows, the present invention will be elucidated further.

The leuco dyes used in the present invention may be leuco substances based on triphenylmethane, phenothiazine, auramine and spiropyrane, and include for example 3, 3-bis(p-dimethylamonophenyl)-6-dimethylaminophthalide (CVL) which is colorless or slightly colored in a normal state, 3, 3-bis(p-dibutylaminophenyl) phthalide (malachite green lactone), 3-dimethylamino-6-methoxyfluoran, 3-diemethylamino-6-methyl-7-chlorofluoran, 3-dimethylamino-5-methyl-7-dibenzylaminofluoran, 3-diethylamino-7-methyoxyfluoran, 3-diethylamino-7-methylaminofluoran, 3-diethylamino-7-dibenzylamino-fluoran, 3-diethylamino-7-(N-methylanilino) fluoran, 3-diethylamino-7-orthochloroanilinofluoran, 3-diethyamino-7, 8-benzofluoran, 3-diethylamino-6-methyl-7-chlorofluoran, 3-diethylamino-6-methyl-7-anilinofluoran, 3-diethylamino-6-methyl-7-p-butylanilinofluoran, 3-diethylamino-5-methyl-7-dibenzylaminofluoran, 3-morpholino-5, 6-benzofluoran, 3-ethyl-6-methyl-7-anilinofluoran, 2-anilino-6-diethylaminofluoran, 3-(N-methyl-N-cyclohexylamino)-6-methyl-7-anilinofluoran, benzoyl leuco methylene blue, N-phenyl rhodamine beta lactam amido rhodamine beta sultone, benzo-beta-naphthospiro-pyrane, 1, 3, 3-trimethyl-6'-chloro-8'-methoxyindolinobenzospiro-pyrane and the like.

The binding agent used in the present invention may be water-soluble polymeric compounds such as polyvinyl alcohol, (modified) starch or its derivatives, methyl cellulose, hydroxyethyl cellulose, carboxylmethyl cellulose, casein or polyacrylate, and polymeric latexes or emulsions such as copolymers of styrene and butadiene or polyacrylic ester; however, the present invention is not restricted to the above-exemplified substances.

The heat-sensitive recording layer according to the present invention may contain the following various substances if required, in addition to the above-mentioned leuco dyes, phenolic compound and binding agent. For example, white pigments such as talc, clay, silica and/or titanium oxide are added for further improvements in the ink-receptible properties, the brightness and the sticking at a thermal head; various types of heat-fusible substances such as waxes, metal salts of higher aliphatic acids and/or amides or higher aliphatic acids for prevention of sticking or color development under pressures; dispersing, wetting and/or anti-foaming agents for further improvements in the dispersibility and the coating properties; and various agents for improving the water-proofness of the coating. Optionally, it may be possible to use the conventional sensitizers in an amount such that no deterioration of other properties takes place, thereby improving further the heat-sensitivity.

In the present invention, any sheet material of a plastic film or the like may be used for the carrier or substrate, to say nothing of sheets of paper.

The present invention will further be explained by the non-restrictive examples given below, in which parts are given by weight.

EXAMPLE 1

| | |
|---|---|
| Liquid A | |
| Crystal violet lactone | 20 parts |
| 10% aqueous solution of polyvinyl alcohol | 50 parts |
| Water | 30 parts |
| Liquid B | |
| Bisphenol A | 10 Parts |
| Calcium corbonate | 20 Parts |
| 10% aqueous solution of polyvinyl alcohol | 30 Parts |
| Water | 40 Parts |
| Liquid C | |
| P-phenylphenol | 10 parts |
| Calcium carbonate | 20 parts |
| 10% aqueous solution of polyvinyl alcohol | 30 parts |
| Water | 40 parts |

-continued

| | |
|---|---|
| Liquid D | |
| P-phenylphenol | 20 parts |
| 10% aqueous solution of polyvinyl alcohol | 50 parts |
| Water | 30 parts |
| Liquid E | |
| Bisphenol A | 10 parts |
| Calcium carbonate | 20 parts |
| Amide stearate | 5 parts |
| 10% aqueous solution of polyvinyl alcohol | 30 parts |
| Water | 35 parts |

Liquids A, B, C, D and E were separately pulverized and dispersed for about 24 hours in a magnetic mill. Thereafter;

(I) Five parts of liquid A, 40 parts of liquid B and 30 parts of a 20% aqueous solution of polyvinyl alcohol are added and well mixed;

(II) Five parts of liquid A, 40 parts of liquid C and 30 parts of 20% aqueous solution of polyvinyl alcohol are added and well mixed;

(III) To liquid (I) are further added 2.5 parts of liquid D, which are well mixed;

(IV) To liquid (I) are further added 5 parts of liquid D, which are well mixed;

(V) To liquid (I) are further added 10 parts of liquid D, which are well mixed;

(VI) To liquid (I) is further added 15 parts of liquid D, which are well mixed; and (VII) Five parts of liquid A, 40 parts of liquid E and 30 parts of a 20% aqueous solution of polyvinyl alcohol are added and well mixed.

Each of the above-mentioned heat-sensitive coating liquids (I) to (VII) was applied on a sheet of general-purpose paper having a weight of 50 g/m$^2$ by means of a Mayer bar, such that the amount thereof is about 10 g/m$^2$ upon drying, and dried in a blow dryer maintained at 55° C. for two minutes, thereby obtaining a heat-sensitive recording sheet. For the chromogenic properties thereof, refer to Table 1.

TABLE 1

| Coating Liquid | Dye | Bisphenol A | P-Phenylphenol | Amide Stearate | Degree of Color Devel. 120° C. | Degree of Color Devel. 140° C. | Estimation |
|---|---|---|---|---|---|---|---|
| (II) | 1 | — | 4 | — | 0.32 | 0.43 | XX |
| (I) | 1 | 4 | — | — | 0.58 | 1.00 | X |
| (III) | 1 | 4 | 0.5 | — | 1.00 | 1.26 | Δ |
| (IV) | 1 | 4 | 1 | — | 1.15 | 1.30 | O |

TABLE 1-continued

| Coating Liquid | Dye | Bisphenol A | P-Phenylphenol | Amide Stearate | Degree of Color Devel. 120° C. | Degree of Color Devel. 140° C. | Estimation |
|---|---|---|---|---|---|---|---|
| (V) | 1 | 4 | 2 | — | 1.23 | 1.31 | O |
| (VI) | 1 | 4 | 3 | — | 1.25 | 1.36 | O |
| (VII) | 1 | 4 | — | 2 | 1.05 | 1.25 | Δ |
| Note | 1 | 7 | — | — | 0.60 | 1.00 | X |

Note:
for comparison with (VI)

EXAMPLE 2

Seven kinds of heat-sensitive recording sheets (I)'-(VII)' were prepared according to the procedures of Example 1, except that 3-diethylmino-7-orthochloroanilinofluoran was used in lieu of crystal violet lactone in liquid A. For the chromogenic properties thereof, see Table 2.

TABLE 2

| Coating Liquid | Dye | Bisphenol A | P-phenyl phenol | Amide Stearate | Degree of Color Devel. 120° C. | Degree of Color Devel. 140° C. | Estimation |
|---|---|---|---|---|---|---|---|
| (II)' | 1 | — | 4 | — | 0.12 | 0.25 | XX |
| (I)' | 1 | 4 | — | — | 0.23 | 0.66 | X |
| (III)' | 1 | 4 | 0.5 | — | 0.67 | 1.16 | Δ |
| (IV)' | 1 | 4 | 1 | — | 0.86 | 1.32 | O |
| (V)' | 1 | 4 | 2 | — | 0.95 | 1.37 | O |
| (VI)' | 1 | 4 | 3 | — | 1.00 | 1.39 | O |
| (VII)' | 1 | 4 | — | 2 | 0.80 | 1.17 | Δ |
| Note | 1 | 7 | — | — | 0.24 | 0.65 | X |

Note:
Determination of the degree of color development
The degree of color development is expressed by a value determined on a Macbeth reflection densiometer (type RD-514) in respect of a sample which is subjected to color development at varying temperatures and a constant pressure of 3 kg/cm$^2$ for one second in a stamp type color-forming device.

In the above Tables, the symbols in the column labelled "Estimation" are of the following significances:

XX=very poor
X=poor
Δ=satisfactory
o=good.

Further, in the Tables the numbers under "Dye", "Bisphenol A", "P-Phenylphenol" and "Amide Stearate" refer to weight ratios. As exemplary, in Table I, liquid II comprises a weight ratio of dye to p-phenylphenol of 1:4.

What is claimed is:

1. A heat-sensitive recording material having a heat-sensitive layer comprising a leuco dye, a phenolic compound and a water-soluble binding agent, wherein said phenolic compound comprises bisphenol A and p-phenylphenol in a ratio by weight between 8:1 and 4:3.

* * * * *